US005201662A

United States Patent [19]

Roche

[11] Patent Number: 5,201,662

[45] Date of Patent: Apr. 13, 1993

[54] ELECTRICAL CONNECTOR FOR MOUNTING ON A PRINTED CIRCUIT BOARD

[75] Inventor: Peter G. Roche, Limerick, Ireland

[73] Assignee: Molex Incorporated, Lisle, Ill.

[21] Appl. No.: 749,250

[22] Filed: Aug. 23, 1991

[51] Int. Cl.[5] ..... H01R 23/70

[52] U.S. Cl. ..... 439/79; 439/377

[58] Field of Search ..... 439/79, 80, 629, 630, 439/377

[56] References Cited

U.S. PATENT DOCUMENTS

| | | | |
|---|---|---|---|
| 3,384,864 | 5/1968 | Schwartz | 439/629 |
| 4,505,035 | 3/1985 | Burton et al. | 29/843 |
| 4,734,042 | 3/1988 | Martens et al. | 439/79 |
| 4,968,266 | 11/1990 | Yamamoto | 439/630 |

FOREIGN PATENT DOCUMENTS

| | | | |
|---|---|---|---|
| 3603250 | 8/1987 | Fed. Rep. of Germany | 439/79 |
| 4027509.4 | 8/1991 | Fed. Rep. of Germany . | |

OTHER PUBLICATIONS

IBM Bulletin, vol. 31, No. 5, p. 73, Oct. 1988.

*Primary Examiner*—Neil Abrams

*Attorney, Agent, or Firm*—Stephen Z. Weiss; A. A. Tirva; Stacey C. Scheer

[57] ABSTRACT

An electrical connector is disclosed for mounting on a surface of a printed circuit board wherein the connector includes a dielectric housing having a bottom mounting face, a forward mating face and a rearward terminating face. A plurality of contact passages are provided in the housing and extending between the forward mating face and the rearward terminating face and defining top and bottom rows and vertical columns of passages, with at least a pair of passages in each column. A plurality of contacts are secured in the passages and have contact sections projecting from the forward mating face and terminating sections projecting from the rearward terminating face connectable to corresponding circuit traces on the printed circuit board. The terminating sections of the contacts in the bottom row thereof are formed at relatively large angles, and the terminating sections of the contacts in the top row thereof are formed at relatively smaller angles, for connection to corresponding circuit traces on the printed circuit board spaced different distances from the rearward terminating face of the housing. The housing has a recessed area in the rearward terminating face encompassing ends of the top row of passages and from which the terminating sections of the top row of contacts project.

2 Claims, 4 Drawing Sheets

ELECTRICAL CONNECTOR FOR MOUNTING ON A PRINTED CIRCUIT BOARD

FIELD OF THE INVENTION

This invention generally relates to the art of electrical connectors and, particularly, to an electrical connector mounted on a surface of a printed circuit board, electrically connecting an electrical device, such as a memory card connector to circuit traces printed on a circuit board.

BACKGROUND OF THE INVENTION

Header connectors are used with IC packs or memory cards for interconnecting the semi-conductor circuit of the IC pack to an external circuit such as a main electronic unit. The IC pack is inserted into the header connector and is extracted therefrom as needed.

Often, such header connectors are configured for mounting on a surface of a printed circuit board. The connector includes a dielectric housing having a forward mating face from which contact sections of a plurality of contacts project for interconnection with the contacts of the IC pack. The housing has a bottom mounting face for mounting the connector on the printed circuit board and a rearward terminating face from which terminating sections of the contacts project for connection to corresponding circuit traces on the printed circuit board. For instance, the terminating sections may have contact pads for soldering to the circuit traces.

With header connectors of the character described above, various problems are encountered in the area of the terminating sections of the contacts. Specifically, the contacts usually are secured in through passages in the dielectric housing. Conventionally, two horizontal rows of passages and corresponding contacts are provided in vertical columns with at least a pair of passages and corresponding contacts in each column. Consequently, the terminating sections of the contacts must project from the rearward terminating face of the dielectric housing at different angles and different distances from the housing for soldering to the circuit traces on the printed circuit board, which, of course, are in different arrays on the surface of the board. Problems are encountered in providing sufficient flexibility for all of the terminating sections regardless of which row of passages within which the respective contacts are secured. Other problems involve providing surfaces on the terminating sections, outside the dielectric housing, without interfering with the rearward terminating face of the housing. In addition, problems are encountered in header connectors of the character described in affording visual observation of the condition of the printed circuit board terminations.

This invention is directed to solving the above problems in a header connector apparatus of the character described.

SUMMARY OF THE INVENTION

An object, therefore, of the invention is to provide a new and improved electrical connector for mounting on a surface of a printed circuit board, such as a header connector for interconnection with IC packs or memory cards.

As disclosed herein, the features of the invention are incorporated in an electrical connector which includes a dielectric housing having a bottom surface for mounting on a surface of a printed circuit board. The housing includes a forward mating face and a rearward terminating face. A plurality of contact passages are provided in the housing extending between the forward mating face and the rearward terminating face and defining top and bottom rows and vertical columns of passages, with at least a pair of passages in each column. A plurality of contacts are secured in the passages and have contact sections projecting from the forward mating face for interconnection with mating contacts of an appropriate IC pack or memory card. The contacts have terminating sections projecting from the rearward terminating face of the housing for connection to corresponding circuit traces on the printed circuit board, as by soldering.

According to one aspect of the invention, the terminating sections of the contacts in the bottom row thereof are formed at a relatively large angle for connection to corresponding circuit traces on the printed circuit board spaced a given distance from the rearward terminating face. The terminating sections of the contacts in the top row thereof are formed at an angle smaller than the relatively large angle for the bottom row contacts for connection to corresponding circuit traces on the printed circuit board spaced a distance from the rearward terminating face less than said given distance.

According to another aspect of the invention, the housing has a recessed area in the rearward terminating face thereof encompassing ends of the top row of passages and from which the terminating sections of the top row of contacts project.

In the preferred embodiment of the invention, the contact sections of the contacts are generally square or rectangular in cross-section. The terminating sections of the contacts in the bottom rows thereof project from the rearward terminating face of the housing generally in the planes of the respective columns of contacts. The terminating sections of the contacts in the top and bottom row in the same vertical plane project from the rearward terminating face offset from the plane opposite from one another.

Other objects, features and advantages of the invention will be apparent from the following detailed description taken in connection with the accompanying drawings.

BRIEF DESCRIPTION OF THE DRAWINGS

The features of this invention which are believed to be novel are set forth with particularity in the appended claims. The invention, together with its objects and the advantages thereof may be best understood by reference to the following description taken in conjunction with the accompanying drawings, in which like reference numerals identify like elements in the figures and in which:

DETAILED DESCRIPTION OF THE PREFERRED EMBODIMENT

Figure 1:
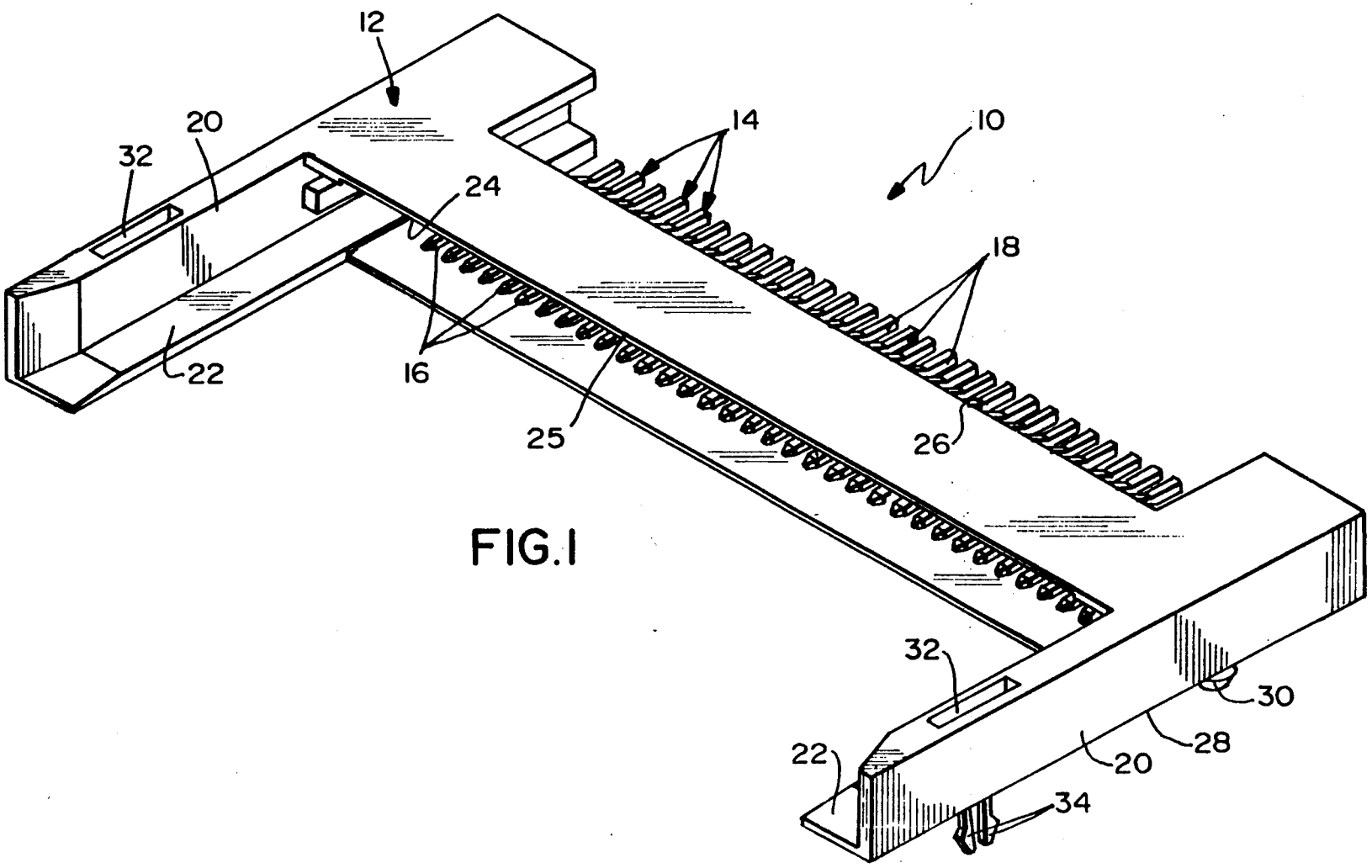
FIG. 1 is a perspective view of the mating end of the electrical connector of the invention.
Figure 2:
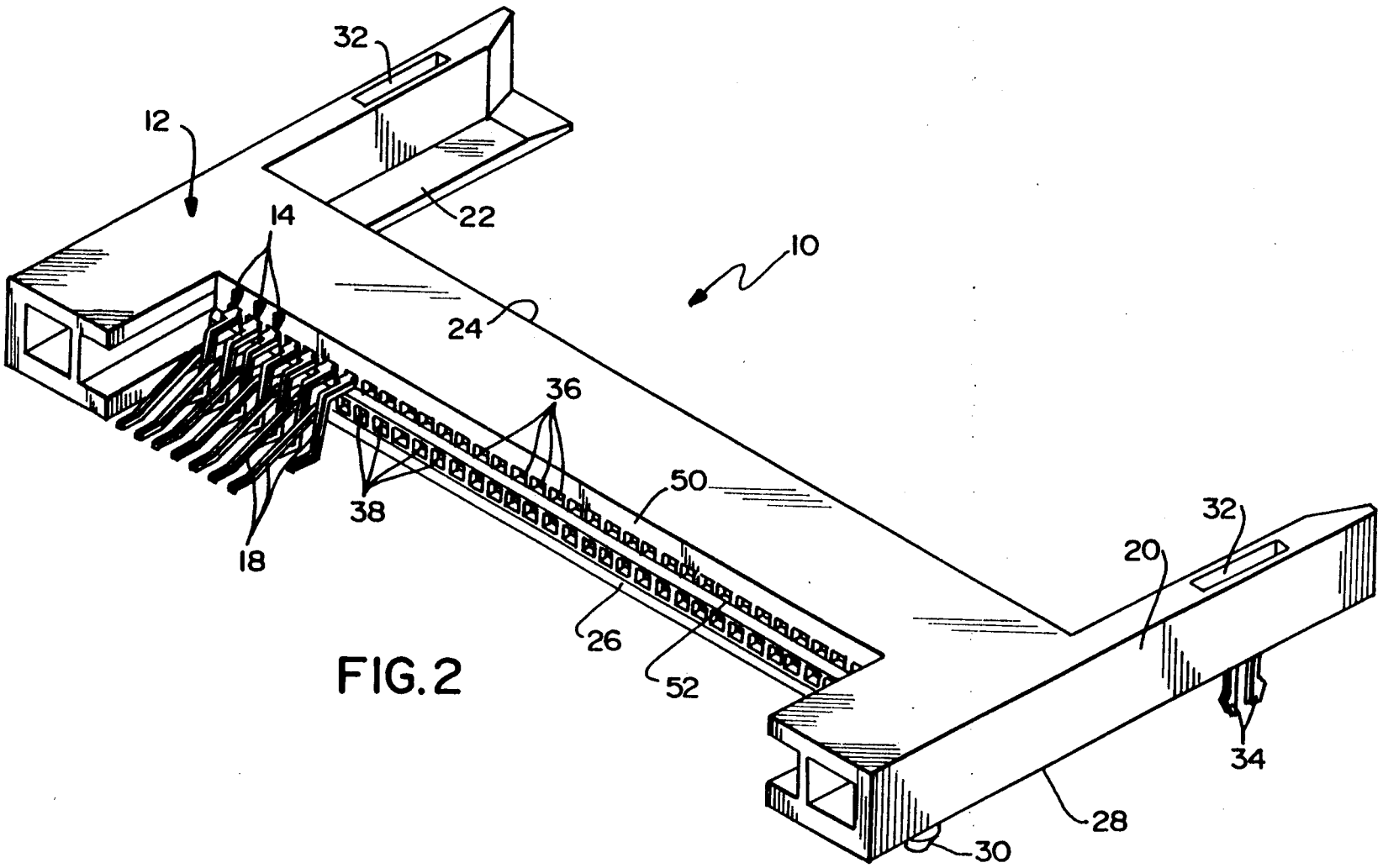
FIG. 2 is a perspective view of the terminating end of the connector.

Referring to the drawings in greater and detail, and first to FIGS. 1 and 2, the embodiment of the invention illustrated herein is incorporated in a header connector apparatus, generally designated 10, which includes a dielectric housing, generally designated 12, integrally molded of dielectric material such a plastic or the like. The housing mounts a plurality of high density contacts, generally designated 14, which include contact sections 16 and terminating sections 18. Contact sections 16 are provided for insertion into contact sockets of an IC pack or memory card (not shown) as is known in the art. Terminating sections 18 are adapted for connecting to corresponding circuit traces on a printed circuit board, as by soldering and as will be described hereinafter.

Housing 12 has a pair of arms 20 defining tracks 22 for guiding a memory card into mating condition with an edge of the card inserted into a transverse receptacle 25 (FIG. 1) for mating of the contact sockets of the card with contact sections 16 of contacts 14 inserted into the contact sockets of the card.

In addition, housing 12 has a forward mating face 24 (FIG. 1), a rearward terminating face 26 (FIG. 2) and a bottom mounting face 28. The bottom face is to be positioned on a surface of a printed circuit board, and means are provided for mounting the housing to the board. Specifically, the housing includes a plurality of integral mounting pegs 30 projecting from bottom face 28 for insertion into appropriate mounting holes in the printed circuit board. In addition, arms 20 of the housing have vertical through slots 32 into which locking clips are inserted to lock the housing to the board. In the drawings, bifurcated locking legs 34 of the locking clips are visible projecting from bottom face 28 in line with slots 32.

As seen best in FIG. 2, housing 12 has a plurality of contact passages 36 and 38 extending between forward mating face 24 and rearward terminating face 26. The contact passages define a top row (passages 36) and a bottom row (passages 38), with a pair of passages, one from each row, in a plurality of transverse columns. In other words, one passage 36 from the top row and a subjacent passage 38 from the bottom row are in a common vertical plane. Consequently, vertical pairs of contact sections 16 of terminals 14 are arranged in vertical pairs transversely of the housing and receptacle 25 therein.

Figure 3:
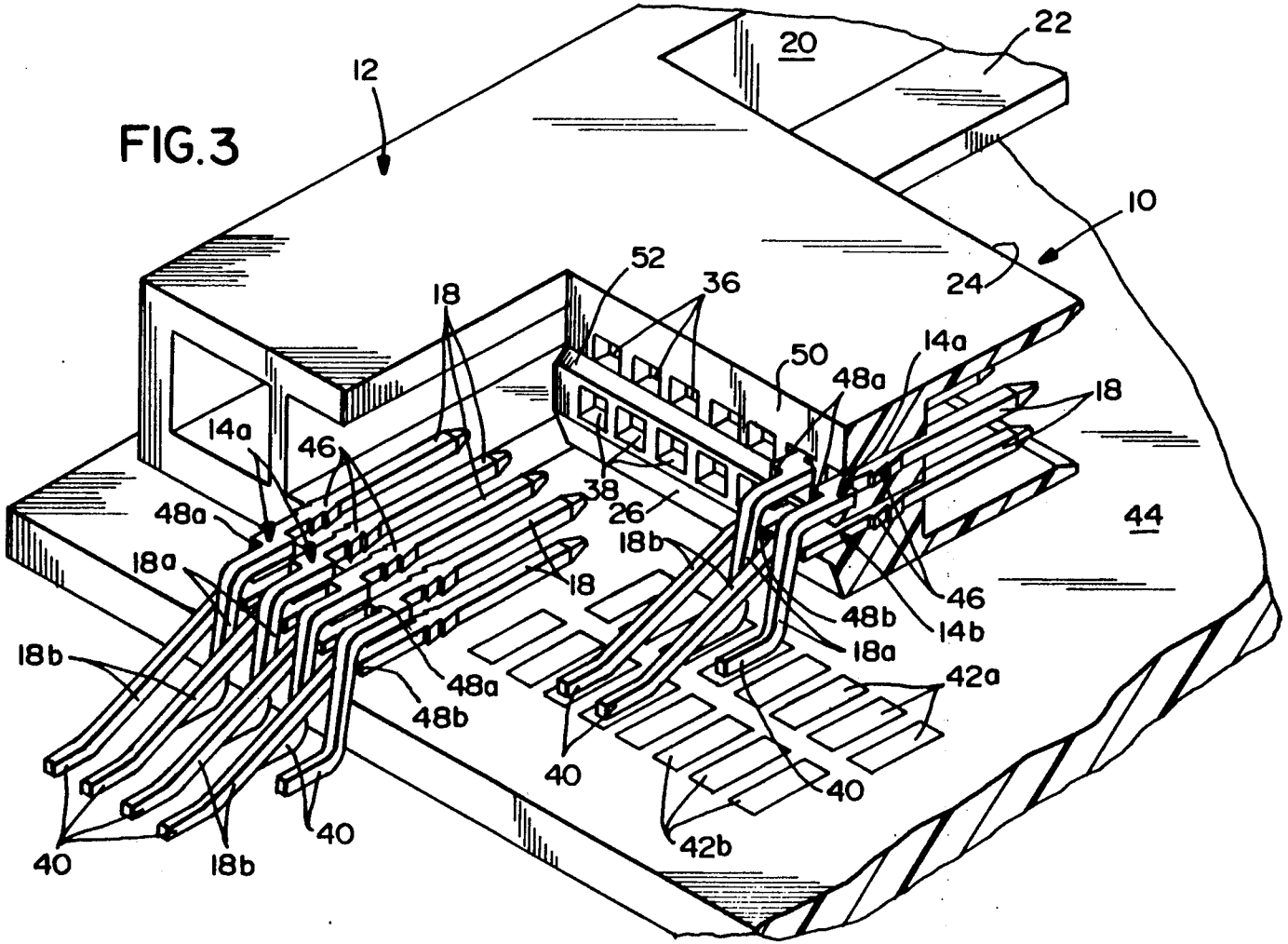
FIG. 3 is a fragmented perspective view of the left-hand portion of the connector as viewed in FIG. 2, with some of the contacts about to be inserted into the connector housing, and with other of the contacts inserted into the housing and mounted to circuit traces on a printed circuit board.

Referring to FIG. 3, contacts 14 described in relation to FIG. 1 have been designated with the reference numerals 14*a* and 14*b* to indicate the "top" contacts and the "bottom" contacts respectively, which have contact sections 16 for insertion into top passages 36 and bottom passages 38 respectively. Consequently, each top contact 14*a* has a terminating section 18*a* and each bottom contact 14*b* has a terminating section 18*b*. Each terminating section 18*a* and 18*b* has distal end 40 which defines a contact area for engaging contact pads 42*a* and 42*b* on a printed circuit board 44 (FIG. 3). In addition, each contact 14*a* and 14*b* has a barbed section 46 which securely seats the contacts within passages 36 and 38. This is seen by the two pairs of contacts 14*a* and 14*b* shown in the cutaway portion on the right side of FIG. 3.

As stated above, each vertical pair of passages 36 and 38 and each corresponding vertical pair of contact sections 18 of a vertical pair of contacts 14*a* and 14*b*, are arranged in a vertical plane. As seen most clearly, in FIG. 3, terminating sections 18*a* of contacts 14*a* and terminating sections 18*b* of contacts 14*b* are disposed on respective opposite sides of the respective plane. In particular, taking any single pair of contacts shown in FIG. 3, top contact 14*a* has a terminating section 18*a* to the right of the plane, and bottom contact 14*b* has a terminating section 18*a* to the left of the respective plane. This offsetting of the terminating sections result in offsetting pads 40 of the contacts for connection to the offset array of circuit traces 42*a* and 42*b* on the printed circuit board. In addition, by offsetting the terminating sections of the contacts, each contact has a transverse shoulder or surface 48*a* for contacts 14*a* and 48*b* for contacts 14*b*. These shoulders or surfaces provide means for appropriate tooling to abut and drive or insert the contacts into their respective passages. In addition, it can be seen by the two pairs of inserted contacts in FIG. 3, that terminating sections 18*b* of bottom contacts 14*b* are formed at a relatively large angle, in relation to terminating sections 18*a* of top contacts 14*a* for connection to corresponding circuit traces 42*b* spaced from rearward terminating face 26 of housing 12 a given distance greater than that of circuit traces 42*a*. Terminating sections 18*a* of top contacts 14*a* are formed at a relatively smaller angle than the angle for the bottom contacts for connection to circuit traces 42*a* on printed circuit board 44 a distance from terminating face 26, which is less than the projecting distance of terminating sections of 18*b* of contacts 14*b*.

Heretofore, it has been difficult to provide sufficient resiliency for the terminating sections of contacts in header connectors of the character described herein. Either the top contacts or the bottom contacts had to be formed at a relatively small angle for engaging circuit traces near the connector housing. Consequently, the terminating sections of those contacts had much to be desired in regard to flexibility or resiliency. The invention contemplates means for solving this problem by providing a housing design which affords substantial resiliency for the smaller angled contacts.

More particularly, as seen in FIGS. 2 and 3, an area 50 of rearward terminating face 26 of housing 12 is recessed, as defined by a step 52, so that the open ends of upper passages 36 are spaced inwardly from the open ends of bottom passages 38. By recessing the housing, the portions of top contacts 14*a* which project outwardly from housing 12 are made longer to provide greater flexibility for terminating sections 18*a* of the top contacts. In addition, the recessed area of the housing provides additional spacing about shoulders 48*a* of top contacts 14*a* to accommodate the insertion tooling which is used to insert the contacts into the passages of the housing. Still further, by recessing the housing about the top passages, versus the bottom passages, an open area is provided along rearward terminating face 26 to afford greater visual observation of the interconnections between pads 40 of the terminating sections of the top contacts 14*a* with circuit traces 42*a* on the printed circuit board, thereby providing easier inspection of the interconnections.

Figure 4:
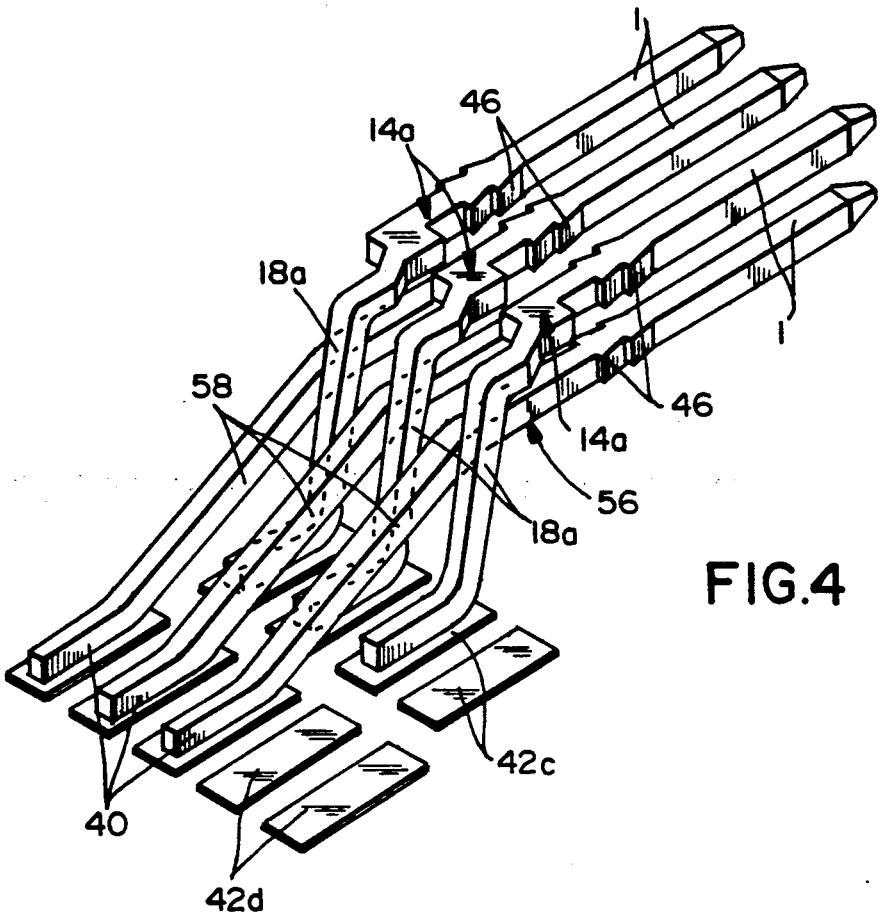
FIG. 4 is a somewhat schematic illustration of a plurality of contacts, according to an alternate embodiment of the invention, surface mounted to circuit traces of an appropriate printed circuit board.
Figure 5:
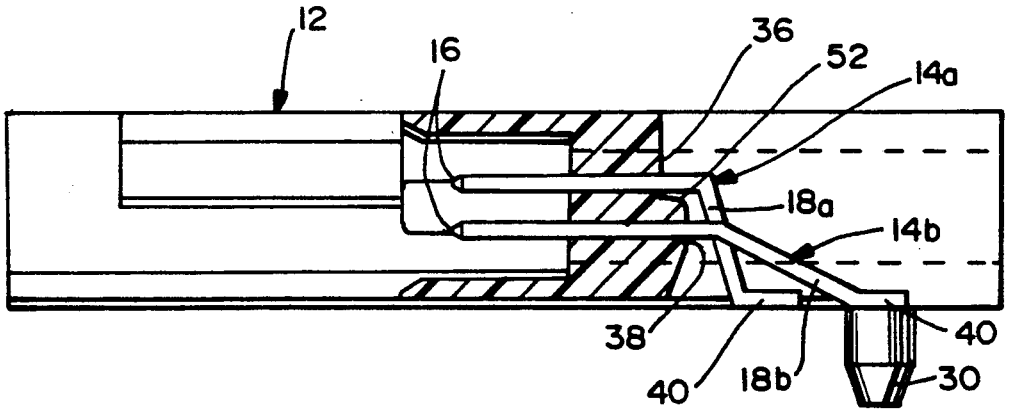
FIG. 5 is a cross-sectional view of the connector.

FIG. 4 shows an alternate construction of the bottom contacts in relation to top contacts 14*a*. Specifically, bottom contacts, generally designated 56, in FIG. 4 again include contact sections 18, contact pads 40 and terminating sections now designated 58, with the terminating sections being in the same plane as contact sections 18 of any given pair of top and bottom contacts. In essence, only top contacts 14*a* have offset terminating sections as shown in the drawing. This arrangement can accommodate circuit traces 42*c* and 42*d* which, may be staggered, with only contact section 18*a* offset relative to the vertical plane of the contact sections while contact sections 58 remain in the plane.

It will be understood that the invention may be embodied in other specific forms without departing from the spirit or central characteristics thereof. The present examples and embodiments, therefore, are to be considered in all respects as illustrative and not restrictive, and the invention is not to be limited to the details given herein.

I claim:

1. In a right angle electrical connector for mounting on a surface of a printed circuit board wherein the connector includes a dielectric housing having a bottom mounting face, a forward mating face, a rearward terminating face, and a plurality of terminal passages extending between the forward mating face and the rearward terminating face and defining top and bottom rows and vertical columns of passages with at least a pair of passages in each column, and a plurality of conductive terminals secured in the passages each having a contact section projecting from said forward mating face and a terminating section projecting from the rearward terminating face including a board-engaging end connectable to corresponding circuit traces on the printed circuit board at a given board angle, the board angle of the terminating sections of the top row being greater than the board angle of the terminating sections of the bottom row, each terminating section defining a mounting arm deflectable about a point generally defined between the contact section and the terminating section in response to a force applied to the board-engaging end of the terminal by the printed circuit board, the improvement comprising:

the section of the rearward terminating face from which the top row of terminating sections project is recessed in a step-like manner towards the forward mating face to provide greater flexibility of the terminating sections of the top row in response to said forces applied to the board-engaging ends by the printed circuit board.

2. In an electrical connector as set forth in claim 1, wherein the terminating sections of the contacts in the bottom row thereof project from the rearward terminating face of the housing generally in the planes of the respective columns of contacts, and the terminating sections of the contacts in the top rows thereof project from the rearward terminating face offset from said planes.

* * * * *